US009284762B2

(12) United States Patent
Gundersen

(10) Patent No.: US 9,284,762 B2
(45) Date of Patent: Mar. 15, 2016

(54) PAN ADAPTER

(71) Applicant: Craig Gundersen, East Dundee, IL (US)

(72) Inventor: Craig Gundersen, East Dundee, IL (US)

( * ) Notice: Subject to any disclaimer, the term of this patent is extended or adjusted under 35 U.S.C. 154(b) by 119 days.

(21) Appl. No.: 14/134,785

(22) Filed: Dec. 19, 2013

(65) Prior Publication Data

US 2015/0176318 A1 Jun. 25, 2015

(51) Int. Cl.

| | |
|---|---|
| ***B65D 43/22*** | (2006.01) |
| ***E05D 7/12*** | (2006.01) |
| ***A47G 19/26*** | (2006.01) |

(52) U.S. Cl.

CPC *E05D 7/12* (2013.01); *A47G 19/26* (2013.01); *B65D 43/22* (2013.01); *E05Y 2600/502* (2013.01); *E05Y 2900/602* (2013.01); *Y10T 16/534* (2015.01)

(58) Field of Classification Search

CPC ..... E05D 7/12; B65D 81/34; B65D 43/22; B65D 43/16; E05Y 2900/602; E05Y 2600/502

USPC ..... 220/810, 827, 823, 825, 833; 16/50, 16/221; 222/556

See application file for complete search history.

(56) References Cited

U.S. PATENT DOCUMENTS

| | | | | |
|---|---|---|---|---|
| 2,546,590 | A * | 3/1951 | Ferrel | 16/302 |
| 3,307,734 | A * | 3/1967 | Campbell | B65F 1/1623 16/75 |
| 5,355,558 | A * | 10/1994 | Vertanen | 16/360 |
| 6,273,288 | B1 | 8/2001 | Jarvis | |
| 6,540,098 | B1 | 4/2003 | Jarvis | |
| 6,568,534 | B2 | 5/2003 | Zank | |
| 7,922,027 | B2 | 4/2011 | Boyden | |
| 8,240,505 | B1 | 8/2012 | Chen | |
| 8,267,269 | B2 | 9/2012 | Gundersen | |

* cited by examiner

*Primary Examiner* — Robert J Hicks
*Assistant Examiner* — Kareen Thomas
(74) *Attorney, Agent, or Firm* — McDonnell Boehnen Hulbert & Berghoff LLP

(57) ABSTRACT

The present disclosure provides an adapter configured to be secured to an edge of a container. The adapter may include a top portion configured to conform to a top surface of the edge of the container. The adapter may also include a bottom portion coupled to the top portion. The bottom portion may include a raised portion configured to conform to a bottom surface of the edge of the container. Further, a bottom surface of the bottom portion may include a substantially planar slot configured to receive a mounting clip. In one example, the mounting clip may be connected to a food guard configured to cover an opening in the container.

15 Claims, 9 Drawing Sheets

PAN ADAPTER

BACKGROUND

Unless otherwise indicated herein, the materials described in this section are not prior art to the claims in this application and are not admitted to be prior art by inclusion in this section.

Serving food in portable containers has become an increasingly prevalent occurrence. Whether it is at a tailgate, picnic, or some other event, portable food containers are likely present. However, containers of open food are often an invitation to insects, or other unsanitary conditions that render the food inedible. Further, exposure to the air may dry out certain foods, or cool previously warm dishes. Therefore, it is desirable for food to be transported and stored with a cover to protect the food from the elements.

In the past, pan covers would simply sit on top of a pan and would be configured to open only part way, typically swinging or sliding into another section of the same cover. In another past embodiment, pan covers would simply sit on top of a pan and would be removed and set aside when serving the food inside of the pan.

The present disclosure describes an adapter structure that can be attached to a plurality of food containers for the purpose of securing a base to which a hinged cover can be attached. With the adapter attached to the container, the complete cover may be supported by one side of the pan and the cover may be opened on that one side, thereby allowing the pan to be accessed from the other three sides. The pan adapter may configured to attach a plurality of lid and pan covers (such as the collapsible food guard described in U.S. Pat. No. 8,267,269, which is incorporated herein by reference in its entirety) to many food pans, platters and cooking sheets used in the market today. The adapter structure may also be configured to support other accessories whose functionality may benefit from being securely attached directly to the pan or container.

SUMMARY

In one aspect, the present disclosure provides an adapter configured to be secured to an edge of a container. The adapter may include a top portion configured to conform to a top surface of the edge of the container. The adapter may also include a bottom portion coupled to the top portion. The bottom portion may include a raised portion configured to conform to a bottom surface of the edge of the container. Further, a bottom surface of the bottom portion may include a substantially planar slot configured to receive a mounting clip. In one example, the mounting clip may be connected to a food guard configured to cover an opening in the container.

In another aspect, the present disclosure provides a system. The system may include a first adapter having a top portion configured to confirm to a top surface of the edge of the container. The first adapter may also include a bottom portion coupled to the top portion. The bottom portion of the first adapter may include a raised portion configured to conform to a bottom surface of the edge of the container. Further, a bottom surface of the bottom portion of the first adapter may include a substantially planar slot. The system may also include a second adapter similarly configured to the first adapter. The system may also include a rigid member configured to couple the first adapter to the second adapter.

In yet another aspect, the present disclosure provides another adapter configured to be secured to an edge of a container. The adapter may include a top portion configured to conform to a top surface of the edge of the container. The adapter may also include a bottom portion coupled to the top portion. The bottom portion may include a raised portion configured to conform to a bottom surface of the edge of the container. The adapter may also include a support member extending vertically from the top portion of the adapter, and a pin coupled to the support member. The pin may be configured to connect to a rotatable component such that the rotatable components rotates about the pin. In one example, the rotatable component may be connected to a food guard configured to cover an opening in the container.

These as well as other aspects, advantages, and alternatives, will become apparent to those of ordinary skill in the art by reading the following detailed description, with reference where appropriate to the accompanying drawings.

DETAILED DESCRIPTION

Exemplary methods and systems are described herein. It should be understood that the word "exemplary" is used herein to mean "serving as an example, instance, or illustration." Any embodiment or feature described herein as "exemplary" is not necessarily to be construed as preferred or advantageous over other embodiments or features. The exemplary embodiments described herein are not meant to be limiting. It will be readily understood that certain aspects of the disclosed systems and methods can be arranged and combined in a wide variety of different configurations, all of which are contemplated herein.

Furthermore, the particular arrangements shown in the Figures should not be viewed as limiting. It should be understood that other embodiments may include more or less of each element shown in a given Figure. Further, some of the illustrated elements may be combined or omitted. Yet further, an exemplary embodiment may include elements that are not illustrated in the Figures.

The present disclosure describes an adapter structure that may be attached to a plurality of food containers for the purpose of securing a substantially planar base to which a plurality of accessories may be attached. As examples, the food containers may include pans, platters, mixing bowls, stainless steel bowls, plastic food containers, and cooking sheets. All of these containers may include an outward projecting edge. The adapter may be configured to conform to the profiles of the outward projecting edge, thereby securing the adapter to the container.

Figure 1:
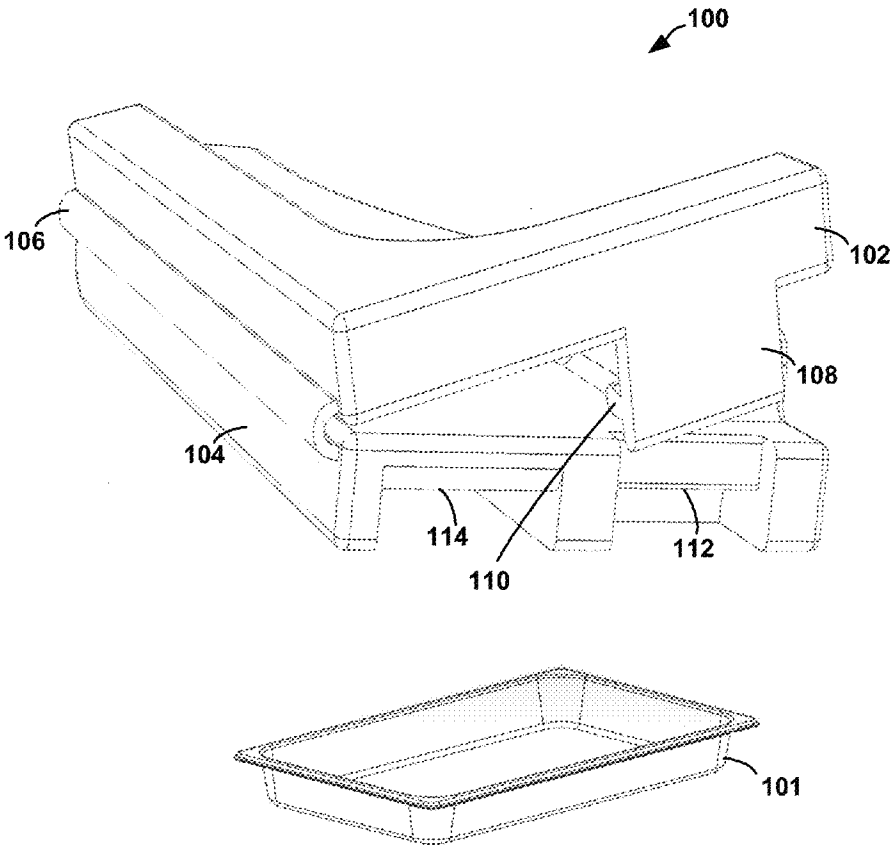
FIG. 1 is a perspective view of an example adapter and an example container, according to an example embodiment.

FIG. 1 illustrates an example adapter 100 and an example container 101, according to an example embodiment. In this specific example, the adapter 100 is configured to attach to a rectangular container 101 having four corners, although other adapters are possible as well. For example, an example adapter may be configured to attach to a circular mixing bowl. As shown in FIG. 1, adapter 100 includes a top portion 102 connected to a bottom portion 104. The top portion 102 and the bottom portion 104 are shown having "L" shaped sections, since adapter 100 is configured to be secured to a corner of the rectangular container 101. Other shapes for the top and bottom portions are possible, depending on the particular container to which the adapter is configured to be attached to.

In one example, the top portion 102 is connected to the bottom portion 104 via a hinge 106 and a latch mechanism 108. The hinge 106 may be metal or plastic, or some other material. In one example, the hinge 106 is secured to the top portion 102 and the bottom portion 104 after fabrication of the top and bottom portions. In another example, the hinge 106 is molded into the top and bottom portions at fabrication as a living hinge. The hinge 106 allows the top portion 102 to be separated from the bottom portion 104, thereby enabling the adapter 100 to be secured to and removed from the container 101. To ensure that the top portion 102 and the bottom portion 104 remain securely attached to the container 101 during use, a latch mechanism 108 is used to prevent the top portion 102 from swinging open. The latch mechanism 108 shown in FIG. 1 is a snap latch, having a hook 110 and a catch 112. In use, the hook 110 is configured to snap into the catch 112, thereby preventing the top section 102 from swinging open during use of the adapter 100. In another example, the latch mechanism 108 may include a swing latch, or a magnetic latch. Other examples are possible as well.

In another example, the top portion 102 is connected to the bottom portion 104 via a spring hinge. The spring may be biased such that the top portion 102 and the bottom portion 104 are pushed together. The top portion 102 and bottom portion 104 may be wedged apart when attaching the adapter 100 to the container 101. Once the adapter 100 is in the correct position, the top portion 102 and the bottom portion 104 may then snap back into place by the constant force asserted by the spring. The spring may be a U-shaped spring, or a torsion spring, and may be made out of plastic, metal, or some other material.

In yet another example, the top portion 102 is connected to the bottom portion 104 via a mechanical connector. In one example, the top portion 102 and the bottom portion 104 may each have a hole punched through them, and the mechanical connector may be placed through the hole to connect the top and bottom portions together. The mechanical connector may be a screw, a nail, a nut and bolt, or a rivet, as examples. Other methods for connecting the top portion 102 to the bottom portion 104 are possible as well.

In one example, the top portion 102 and the bottom portion 104 are made from the same material. The material may be plastic, such as nylons, polycarbonates, polyesters, co-polyesters, urethanes, and ABS as examples. In another example, the material may be metal, such as stainless steel, copper, aluminum, and tin as examples. In another example, the top portion 102 and the bottom portion 104 are made from different materials.

Figure 2:
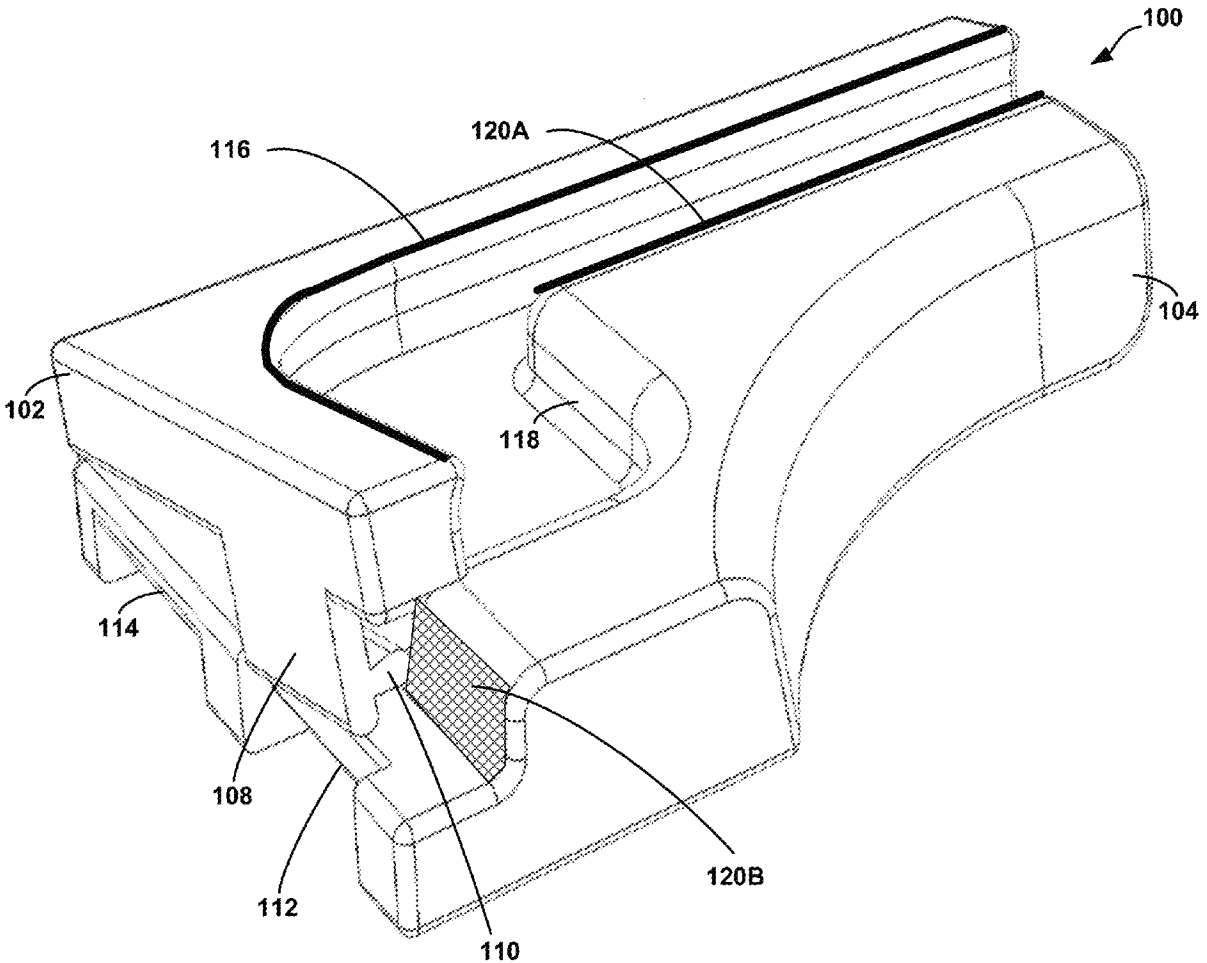
FIG. 2 is another perspective view of an example adapter, according to an example embodiment.

FIG. 2 is another perspective view of the example adapter 100, according to an example embodiment. As illustrated in FIG. 2, the top portion 102 of the adapter 100 is configured to conform to the top surface of the edge of the container 101. In particular, an interior edge 116 of the top portion 102 is configured to mirror the top surface of the edge of the container 101. The bottom portion 104 of the adapter 100 may include a raised portion 118. When the top surface 102 and the bottom surface 104 are secured to the container 101, the raised portion 118 is configured to conform to a bottom surface of the edge of the container 101. In particular, a first face 120A of the raised portion 118 is configured to conform to a first section of the bottom surface of the edge of the container 101, and a second face 120B of the raised portion 118 is configured to conform to a second section of the bottom surface of the edge of the container 101. When the top portion 102 and the bottom portion 104 are positioned on the container 101 and secured to one another, the adapter 100 will not move until the top and bottom portions are separated.

Figure 3:
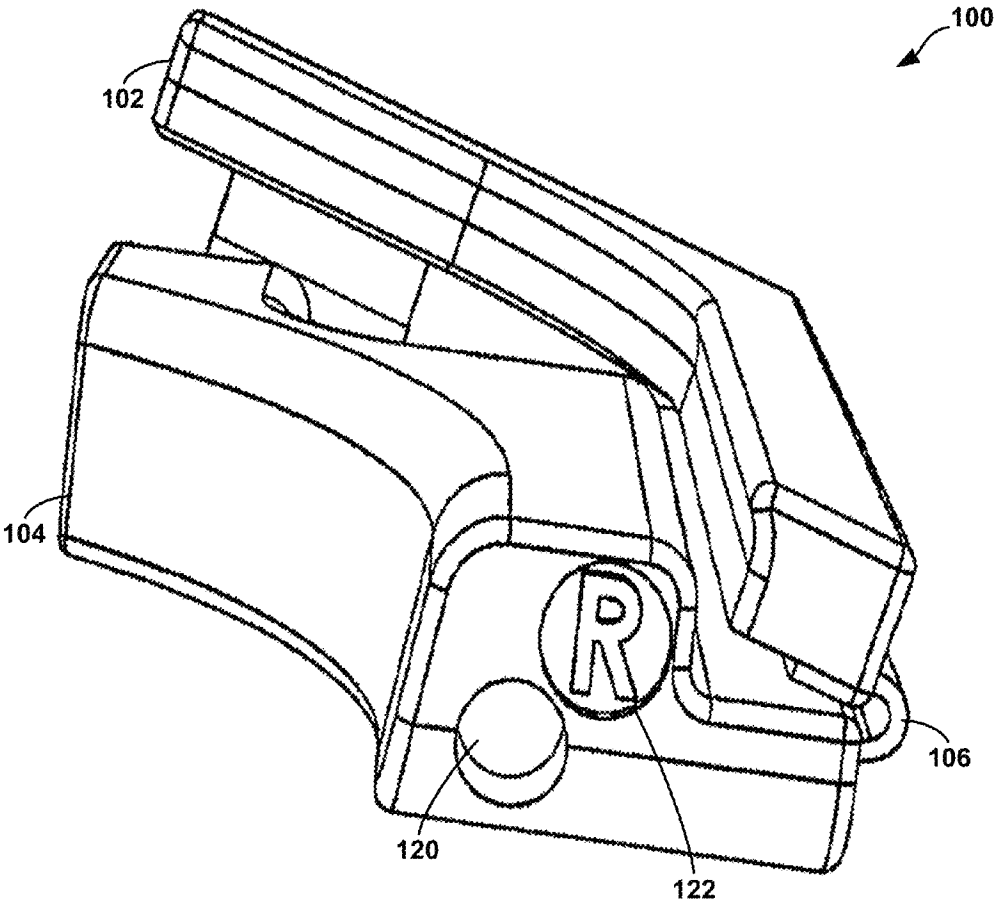
FIG. 3 is another perspective view of an example adapter, according to an example embodiment.

FIG. 3 illustrates a perspective view of the side of the example adapter 100. The bottom portion 104 is shown in FIG. 3 with a hole 120. The hole may be used to connect a first adapter to a second adapter during storage, for example by use of a ring. The second adapter may be configured similarly to the first adapter, as described above. The first and second adapters may be positioned on neighboring corners of a rectangular container 101, as an example. The first and second adapters may be connected with a rigid member. The rigid member may be press fit into a coupling hole (not shown) in the first and second adapters, glued into the coupling hole, or screwed into the coupling hole, as examples. Other methods of connected the rigid member to the first and second adapters are possible as well. In another example, the first and second adapters may be part of a single mold, such that the first adapter, second adapter, and rigid member are all one piece of molded material.

Additionally, FIG. 3 illustrates an indicator 122 inscribed in the bottom portion 104 of the adapter 100. As shown, the indicator is an "R", representing that the adapter 100 should be positioned on a right-hand corner of the container 101. Continuing with the example, an "L" may be inscribed on a second adapter, such that a user would know how to properly install the pair of adapters on the container 101.

Figure 4:
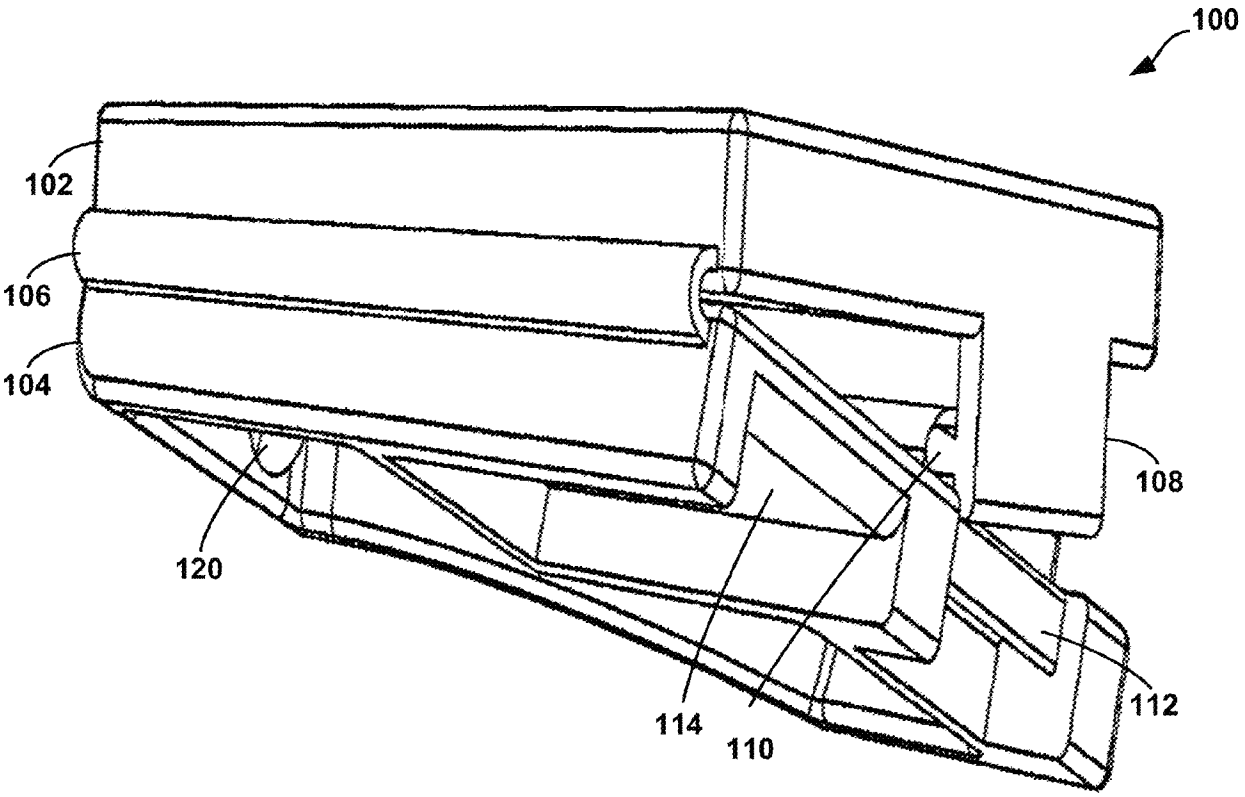
FIG. 4 is another perspective view of an example adapter, according to an example embodiment.

FIG. 4 illustrates a perspective view of the bottom of the example adapter 100. As shown in FIG. 4, the bottom section 104 may include a substantially planar slot 114. The slot 114 may be configured to receive a mounting clip, as discussed in more detail below. The mounting clip is configured such that a plurality of accessories can be connected to the container 101 via the mounting clip. The accessories may include a food guard, a lid cradle, a spoon cradle, a heating lamp, and a light, as examples.

Figure 5:
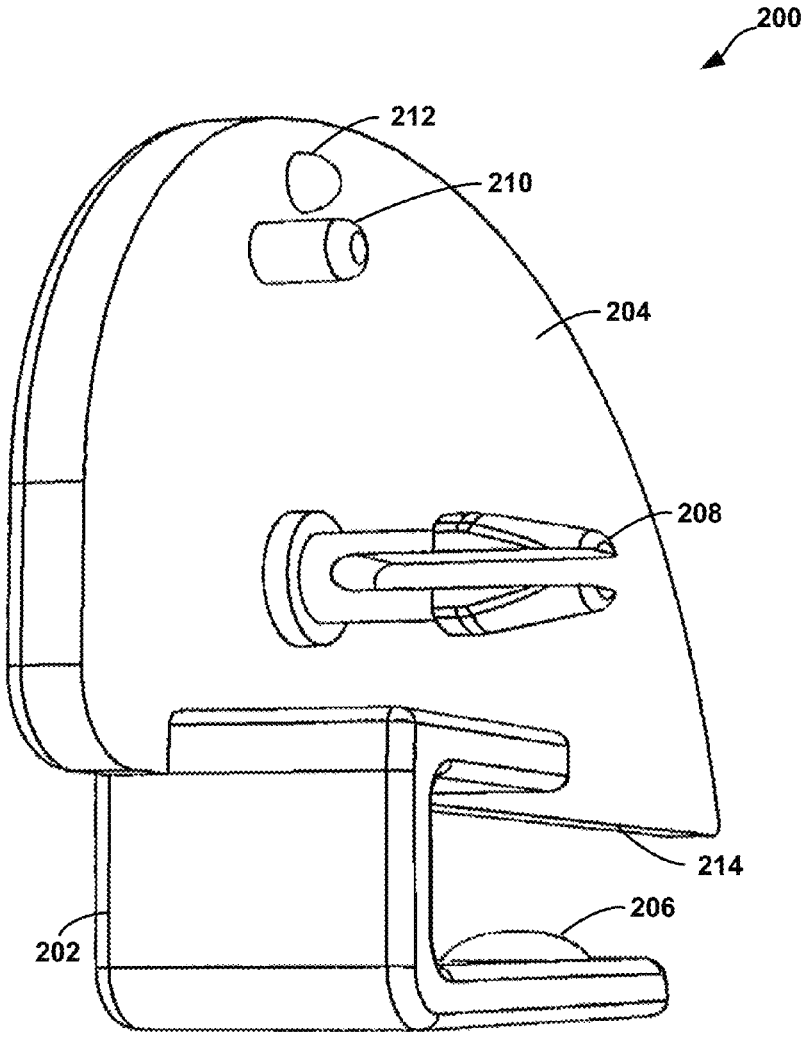
FIG. 5 is a perspective view of an example mounting clip, according to an example embodiment.

FIG. 5 is a perspective view of an example mounting clip 200, according to an example embodiment. The mounting clip 200 may include a U-shaped portion 202 positioned below an interior face 204. The U-shaped portion 202 has its respective side arms gapped for slideably receiving and frictionally engaging the corresponding top portion 102 and slot 114 of the adapter 100. Although the gap in the U-shaped portion 202 may be any size to slideably accommodate the thickness of the adapter 100, typically, the gap between the opposing arms of the U-shaped portion 202 is between ¼ of an inch and 1 inch. More typically, the gap is within the range of ⅜ inch to ¼ inch. In one example, the slot 114 of the adapter 100 may include a groove (not shown), and the U-shaped portion 202 may include a bead 206 configured to engage the groove to secure the mounting clip 200 to the adapter 100. The mounting clip 200 may also include a slotted pin 208, a spring post 210, and a knob 212. These components will be discussed in more detail in relation to FIG. 6 below.

Figure 6:
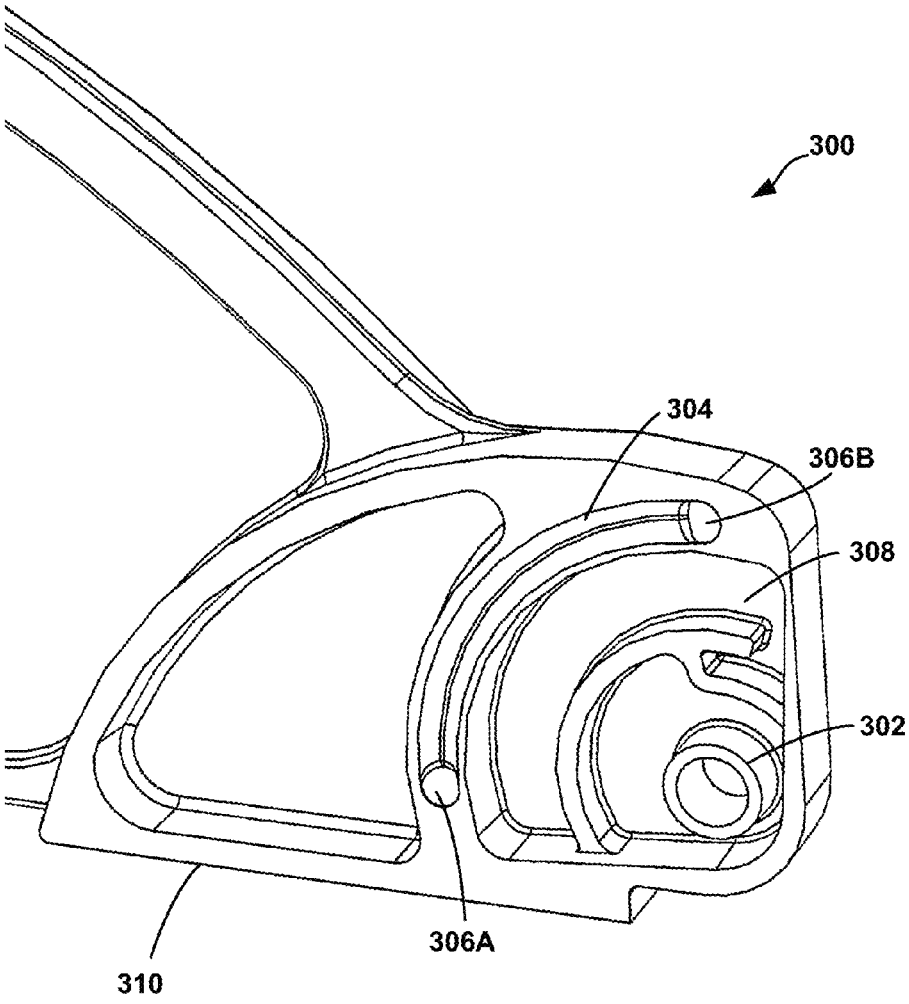
FIG. 6 is a perspective view of an example rotatable component, according to an example embodiment.

FIG. 6 is a perspective view of an example rotatable component 300, according to an example embodiment. The slotted pin 208 of the mounting clip is configured to fit through a hole 302 in the rotatable component 300. The two portions of the slotted pin 202 move together to enable the hinge pin 202 to fit through the hole 302, and subsequently expand to their neutral position once the hinge pin 202 is through the hole 302. The hinge pin 202 thereby secures the rotatable component 300 to the mounting clip 200, and enables the rotatable component 300 to rotate around the hinge pin 202. In another example, the adapter 100 may include a support member extending vertically from the top portion 102. A pin may be coupled to the support member, such that the rotatable component 300 may be coupled directly to the adapter 100 via the pin.

The rotatable component 300 may also include a grooved track 304. The grooved track 304 may be configured to receive the knob 212 of the mounting clip 200. As the rotatable component 300 rotates around the slotted pin 208, the knob 212 follows the grooved track 304. The grooved track 304 may include locking positions 306A, 306B. The locking positions 306A, 306B may be depressions in the grooved track 304 that mirror the shape of the knob 212. As the rotatable component 300 rotates around the slotted pin 208, the rotatable component 300 may lock into a particular position when the knob 212 enters one of the locking positions 306A, 306B.

The example shown in FIG. 6 illustrates two locking positions. The first locking position 306A represents a situation where the rotatable component 300 is in a completely closed position, and a bottom surface 214 of the mounting clip 200 is flush with a bottom surface 310 of the rotatable component 300. The second locking position 306B represents a situation where the rotatable component 300 is in a fully open position, and the bottom surface 214 of the mounting clip 200 is perpendicular to the bottom surface 310 of the rotatable component 300. Other potential locking positions are possible as well, such as a situation where the rotatable component is partially open.

The rotatable component 300 may also include a compartment 308. The compartment 308 may house a spring (not shown) configured to bias the rotatable component 300 to a particular position. The spring may be configured to contact the spring post 210 of the mounting clip 200, such that as the rotatable component 300 rotates around the hinge pin 202, the spring is engaged by the spring post 210. In one example, the spring may be configured to bias the rotatable component 300 to a closed position. In another example, the spring may be configured to bias the rotatable component 300 to an open position. In another example, the compartment 308 may house a damper (not shown). The damper may be configured to slow the closing of the pan cover such that the pan cover does not slam shut.

The rotatable component 300 may be a standalone component that may be subsequently connected to a food guard, or some other component. In another example, the rotatable component 300 may be fabricated directly into a portion of the food guard. In either embodiment, as the rotatable component 300 rotates around the hinge pin 208, the food guard rotates from first position in which an opening in the container is covered, to a second position in which the opening in the container is uncovered.

Figure 7:
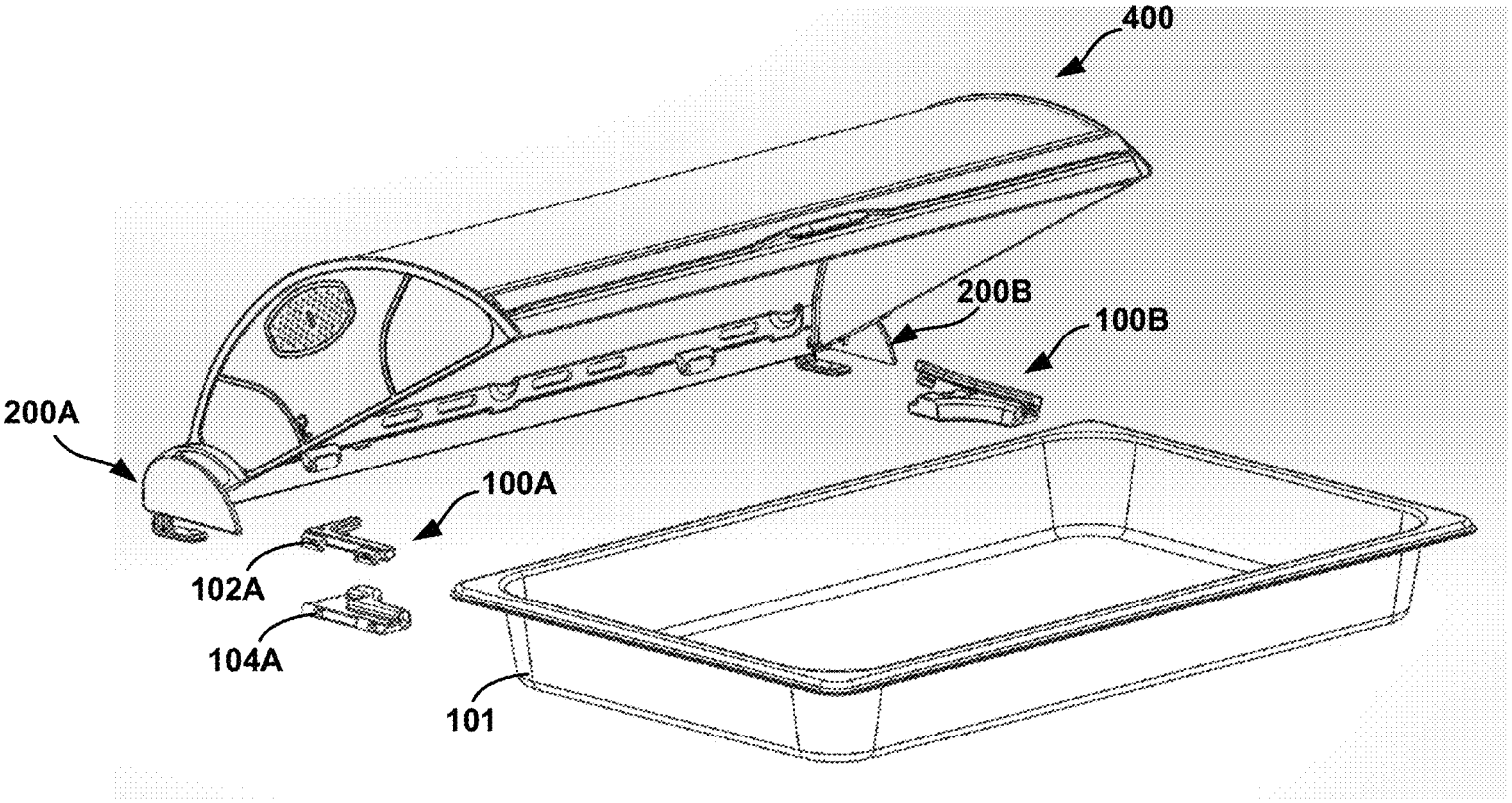
FIG. 7 is an exploded view of an example system, according to an example embodiment.
Figure 8:
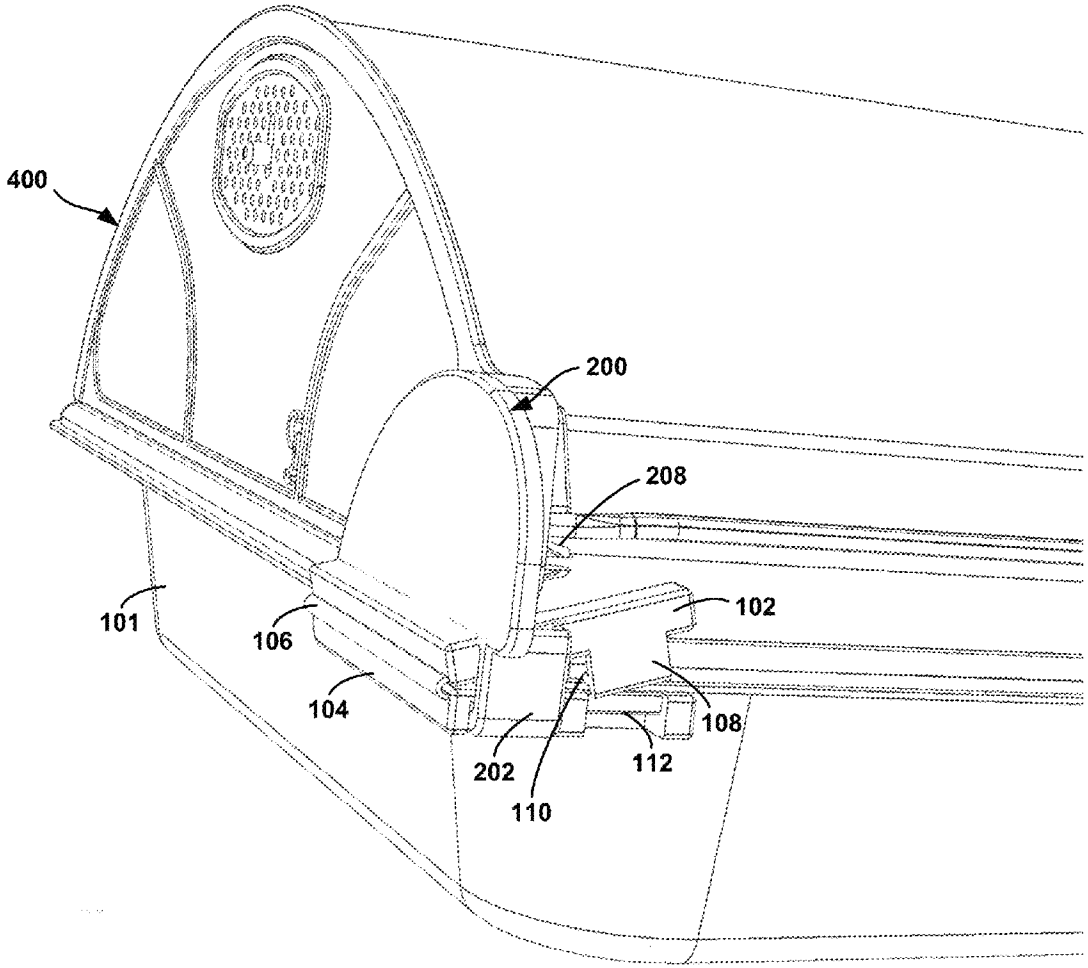
FIG. 8 is a perspective view of an example system, according to an example embodiment.
Figure 9:
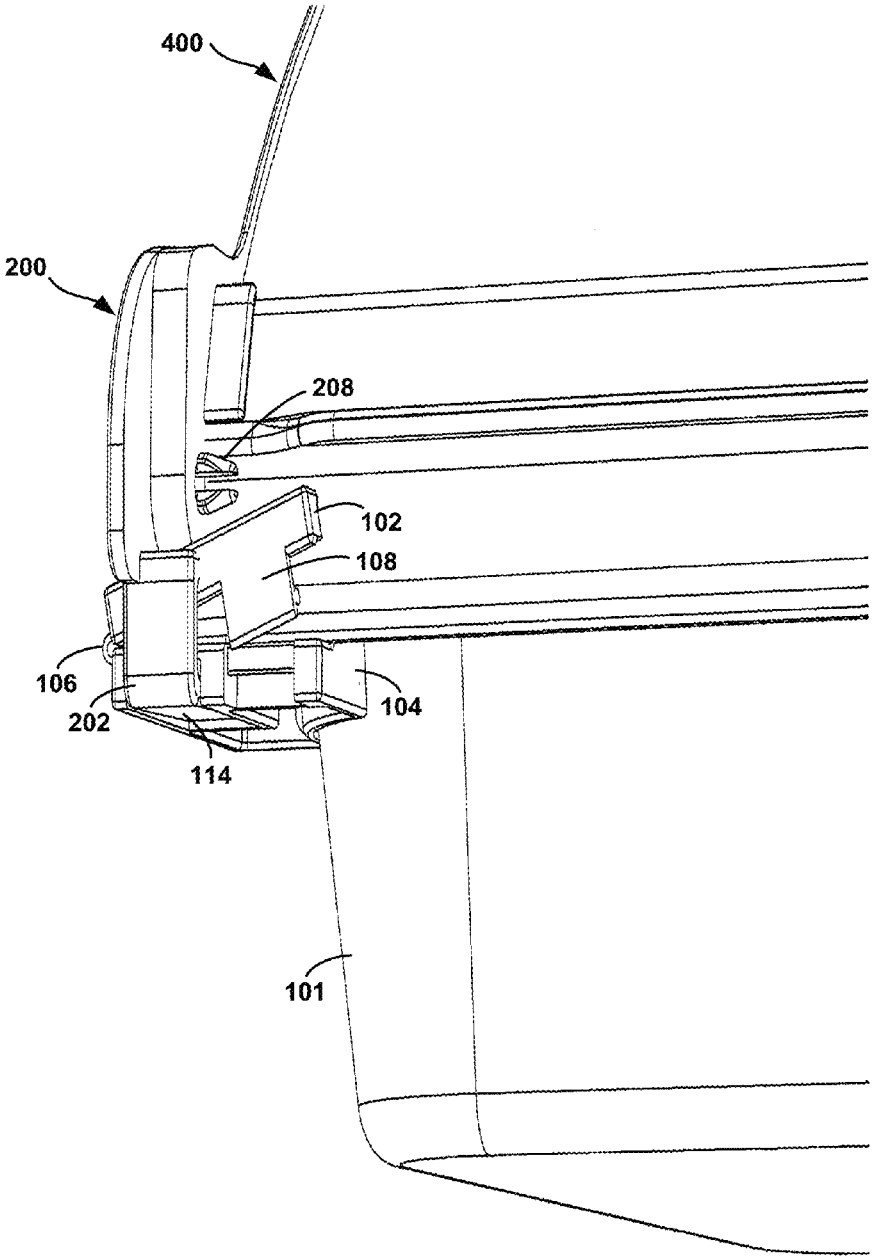
FIG. 9 is a perspective view of an example system, according to an example embodiment.

FIG. 7 is an exploded view of an example system, according to an example embodiment. FIG. 7 illustrates an example container 101, a first adapter 100A having a top portion 102A and a bottom portion 104A, a second adapter 100B, a first mounting clip 200A, a second mounting clip 200B, and a food guard 400 coupled to the first and second mounting clips. FIGS. 8 and 9 illustrate a perspective view of one side of the example system, including many of the components discussed in the previous figures. FIGS. 8 and 9 illustrate the adapter 100 coupled to the container 101, and the mounting clip 200 coupled to the adapter 100. The rotatable component 300 is not shown in these figures, but would be located between the mounting clip 200 and the food container 400. Alternatively, the rotatable component 300 may be fabricated directly into a side portion of the food guard 400. As the food guard 400 rotates from first position in which an opening in the container 101 is covered to a second position in which the opening in the container 101 is uncovered, the rotatable component 300 is configured to rotate around the hinge pin 208.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the claims.

What is claimed is:

1. An adapter system configured to be secured to an edge of a container, the adapter system comprising:

a first adapter including (i) a first top portion configured to conform to a top surface of the edge of the container, and (ii) a first bottom portion coupled to the first top portion, wherein the first bottom portion includes a first raised portion configured to conform to a bottom surface of the edge of the container, and wherein a first bottom surface of the first bottom portion includes a first substantially planar slot;

a second adapter including (i) a second top portion configured to conform to the top surface of the edge of the container, and (ii) a second bottom portion coupled to the second top portion, wherein the second bottom portion includes a second raised portion configured to conform to the bottom surface of the edge of the container, and wherein a second bottom surface of the second bottom portion includes a second substantially planar slot;

a rigid member coupling the first adapter to the second adapter;

a first mounting clip secured to the first adapter via the substantially planar slot of the first adapter;

a second mounting clip secured to the second adapter via the substantially planar slot of the second adapter; and a food guard coupled to the first and second mounting clips such that when the food guard is in a closed position, the food guard covers an opening in the container.

2. The adapter system of claim 1, wherein each of the first mounting clip and the second mounting clip is configured to connect to a rotatable component.

3. The adapter system of claim 2, wherein each of the first substantially planar slot and the second substantially planar slot includes a groove, and wherein each of the first mounting clip and the second mounting clip includes a bead configured to engage the groove to secure a given mounting clip to a corresponding adapter.

4. The adapter system of claim 2, wherein each of the first mounting clip and the second mounting clip includes a pin configured to connecting a given mounting clip to the rotatable component.

5. The adapter system of claim 1, wherein the first top portion is connected to the first bottom portion via a first hinge and a first latch mechanism configured to secure the first top portion to the first bottom portion, and wherein the second top portion is connected to the second bottom portion via a second hinge and a second latch mechanism configured to secure the second top portion to the second bottom portion.

6. The adapter system of claim 1, wherein the first top portion is connected to the first bottom portion and the second top portion is connected to the second bottom portion via a mechanical connector selected from the group consisting of a screw, a nail, a nut and a bolt, and a rivet.

7. The adapter system of claim 1, wherein the first top portion is connected to the first bottom portion via a first spring hinge, wherein the first spring hinge is biased to a closed position in which the first top portion and the first bottom portion of the first adapter are pushed together, wherein the second top portion is connected to the second bottom portion via a second spring hinge, and wherein the second spring hinge is biased to a closed position in which the second top portion and the second bottom portion of the second adapter are pushed together.

8. The adapter system of claim 1, wherein each of the first top portion, the first bottom portion, the second top portion, and the second bottom portion are made from the same material.

9. The adapter system of claim 8, wherein the material is a plastic selected from the group consisting of nylon, polycarbonate, polyester, co-polyester, and urethane.

10. The adapter system of claim 8, wherein the material is a metal selected from the group consisting of stainless steel, copper, aluminum and tin.

11. The adapter system of claim 1, wherein each of the first top portion, the first bottom portion, the second top portion, and the second bottom portion are made from different materials.

12. The adapter system of claim 1, wherein the edge of the container includes four corners, wherein the first adapter is configured to be secured to one of the four corners, and wherein the second adapter is configured to be secured to another one of the four corners.

13. The adapter system of claim 1, wherein the edge of the container is circular.

14. The adapter system of claim 1, wherein the first adapter is secured to a first corner of a container, and wherein the second adapter is secured to a second corner of the container.

15. The adapter system of claim 1, further comprising:

a first rotatable component configured to couple the first mounting clip to the food guard; and a second rotatable component configured to couple the second mounting clip to the food guard, wherein the first and second rotatable components are configured to enable the food guard to rotate from a first position in which an opening in the container is covered, to a second position in which the opening in the container is uncovered.

* * * * *